United States Patent [19]

Ramillon

[11] 4,004,818

[45] Jan. 25, 1977

[54] HANDLE FOR SKI POLE

[76] Inventor: René Ramillon, 3 rue Emile-Zola, Grenoble, France

[22] Filed: July 1, 1974

[21] Appl. No.: 484,960

[30] Foreign Application Priority Data

July 3, 1973 France ..... 73.25311

[52] U.S. Cl. ..... 280/11.37 H

[51] Int. Cl.[2] ..... A63C 11/22

[58] Field of Search ..... 280/11.37 H, 11.37 D; 224/45 P, 45 S; 135/45 R, 51; 30/340, 125; 294/131; 2/16, 17

[56] References Cited

UNITED STATES PATENTS

| | | | |
|---|---|---|---|
| 1,297,661 | 3/1919 | Cooper | 294/131 |
| 2,591,523 | 4/1952 | Dick | 2/17 |
| 3,436,090 | 4/1969 | Lange et al. | 280/11.37 H |
| 3,479,045 | 11/1969 | Miller | 280/11.37 H |
| 3,565,451 | 2/1971 | Giambazi | 280/11.37 H |
| 3,746,356 | 7/1973 | Shipstad | 280/11.37 H |
| 3,880,443 | 4/1975 | Tobin | 280/11.37 H |

FOREIGN PATENTS OR APPLICATIONS

| | | | |
|---|---|---|---|
| 1,369,228 | 6/1964 | France | 280/11.37 H |
| 47-28076 | 11/1972 | Japan | 280/11.37 H |

*Primary Examiner*—Robert R. Song
*Assistant Examiner*—David M. Mitchell
*Attorney, Agent, or Firm*—Karl F. Ross; Herbert Dubno

[57] ABSTRACT

A ski-pole handle has an elastomeric body adapted to be gripped by the hand of a skier and a guard member secured to the pole immediately below the grip body and extending upwardly along-side the body spaced therefrom to overlie the back of the hand gripping the body. This guard member resiliently presses the hand against the grip body and is inwardly concave so as to protect the back of the hand of the skier. The end of the grip body is mushroomed so as to further protect the hand of the skier and to prevent the pole from being pulled out of his hand. The guard member may be formed integrally of synthetic-resin material with the grip body, or may be provided on a separate ring carried on a steel sleeve passing through the body coaxially thereto and surrounding the stem of the pole to allow the guard member to be angularly adjusted relative to the body.

3 Claims, 4 Drawing Figures

HANDLE FOR SKI POLE

FIELD OF THE INVENTION

The present invention relates to a handle for a ski pole.

BACKGROUND OF THE INVENTION

A ski-pole handle is known comprising a tubular grip portion which is fitted over the upper end of the ski pole and which is provided with a closed strap or lanyard adapted to fit around the wrist of the user. In this manner even if the user accidently or intentionally releases the grip he will not drop his ski pole.

Such an arrangement has several disadvantages. First of all even though the strap prevents the skier from completely losing his pole he must usually come to a stop before he can regain a proper grip thereon. In addition the fingers and knuckles of the skier are exposed to injury, in particular in slalom events when passing through gates.

Another considerable disadvantage is that if the ski pole catches on some fixed objects while the skier is moving at high speed the shoulder of the skier is wrenched badly. This is due to the fact that the strap is wrapped around the wrist of the skier and secured firmly to the ski pole.

OBJECTS OF THE INVENTION

It is therefore an object of the present invention to provide an improved handle for a ski pole.

Another object is the provision of such a handle which overcomes the above-given disadvantages.

Yet another object is the provision of a ski-pole handle which is inexpensive to manufacture, and which protects the hand of the skier while making it difficult for him to drop his ski pole at the same time allowing the ski pole to be pulled from his hand without injuring him.

SUMMARY OF THE INVENTION

These objects are attained according to the present invention in a ski-pole handle comprising a tubular grip body adapted to fit over the upper end of the ski pole and to be held in the hand of the user, and an elongated guard member secured to the pole immediately below the grip body and extending upwardly alongside the body spaced therefrom to overlie the back of the hand gripping the body. Such a handle insures that the back of the skier's hand is protected while at the same time the guard member presses the hand tightly against the palm and makes it difficult for the pole to be inadvertently released. However, a sharp pull on the pole will allow the skier to release the entire pole if desired.

In accordance with another feature of this invention the handle is made of a material which is supple and resilient, e.g. an elastomer such as rubber or a synthetic resin, and allows the hand of the skier to get a very good grip. Thus the guard member presses resiliently against the back of the hand of the skier.

In accordance with yet another feature of this invention the guard member is concave toward the ski pole and extends over an angle centered on the axis of the ski pole of between 45° and 75°.

According to yet another feature of this invention the grip body and guard member are unitarily formed of the same piece of synthetic-resin material.

It is also possible in accordance with this invention to provide the guard member on a separate ring secured about the ski pole directly below the grip body so that the user can angularly adjust the position of the guard member relative to the grip body.

According to yet another feature of this invention the handle further comprises a central metallic sleeve to which the elongated guard member is angularly secured and which passes up through the grip body. This grip body is rotatable about the sleeve to allow adjustment of the handle parts during fabrication of the ski-pole handle.

BRIEF DESCRIPTION OF THE DRAWING

The above and other objects, features and advantages will become more readily apparent from the following description, reference being made to the accompanying drawing, in which.

SPECIFIC DESCRIPTION

Figure 1:
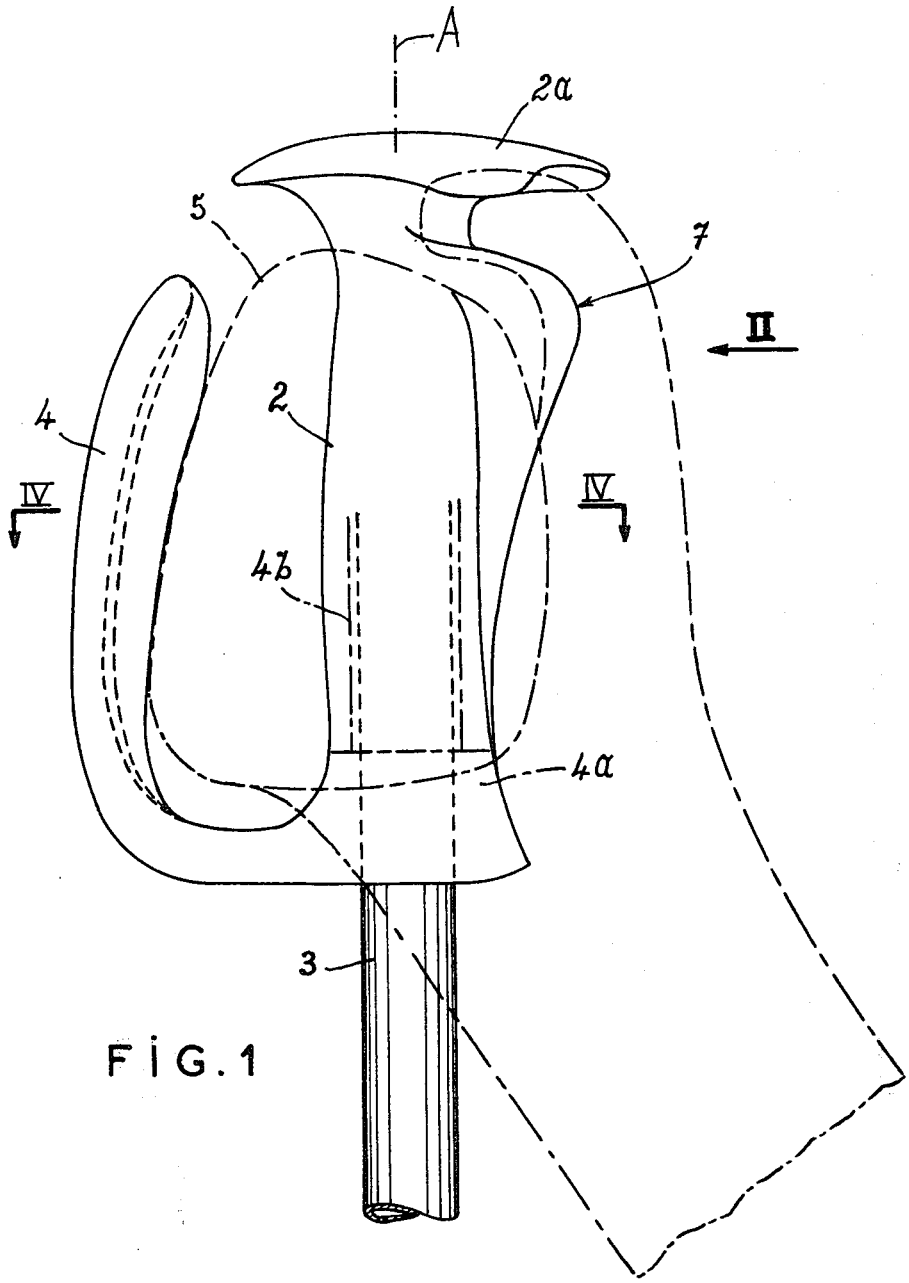
FIG. 1 is a side view of a handle according to the present invention.
Figure 2:
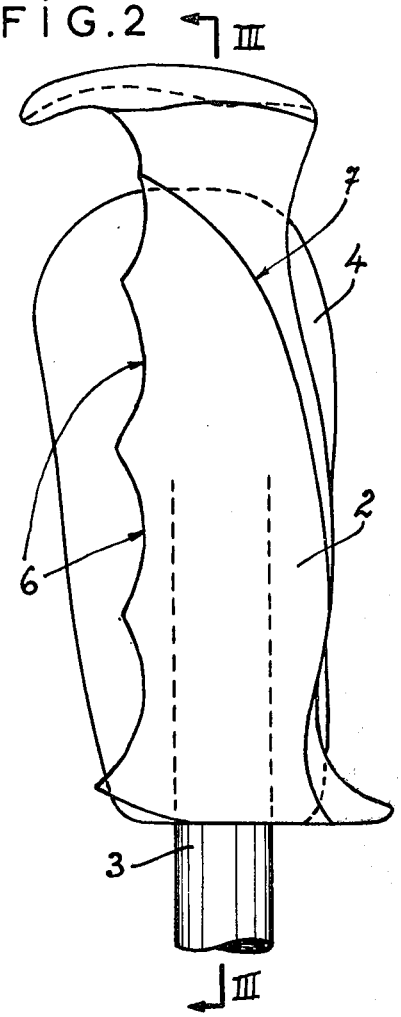
FIG. 2 is a view taken in the direction of arrow II of the handle of FIG. 1.

As shown in FIG. 1 a handle for a ski pole 3 comprises a grip body 2 secured over the end of the ski pole 3, and an elongated guard member 4 which is secured to the pole immediately below the body 2 and extends upwardly alongside the body spaced therefrom so as to overlie the back of the hand 5 gripping the body 2.

Figure 4:
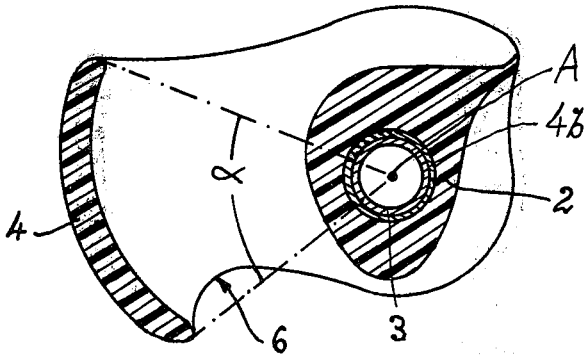
FIG. 4 is a section along line IV—IV of FIG. 1.

The guard member 4 as shown in FIG. 4 extends over an angle $\alpha$ centered on the axis A of the pole 3 and equal to 60°. This guard member 4 is inwardly concave and serves to protect and shield a substantial region of the back of the hand of the user. A ring 4*a* secured on a steel sleeve 4*b* tightly received on the pole 3 carries the member 4. The grip body 2 is rotatable about axis A on the sleeve 4*b*.

The grip body 2 is formed with indentations 6 adapted to provide a comfortable grip for the fingers of the hand 5. In addition a ridge 7 on the body 2 forms a comfortable and secure seat for the thumb of the hand 5.

Figure 3:
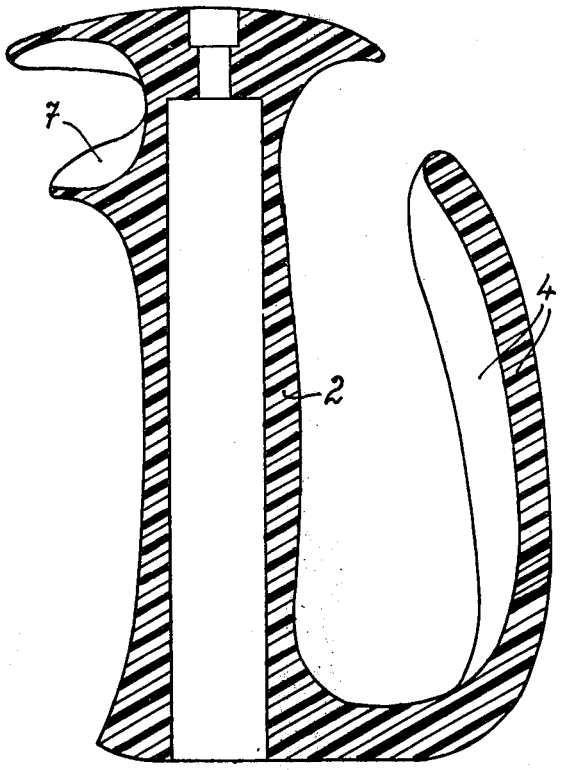
FIG. 3 is a sectional view through another handle of the present invention taken generally along the line III—III of FIG. 2.

The end of the body 2 is mushroomed as shown at 2*a* to provide a shield at the end of the handle which both serves to protect the hand of the user and at the same time to prevent the ski pole from being inadvertently pulled out of the hand 5. FIG. 3 shows the guard member 4 molded integrally with the grip body 2.

I claim:

1. A handle for a ski pole, said handle comprising:

an elongate tubular grip body adapted to fit over the upper end of a ski pole and to fit into the hand of a user; and an elongated resilient guard member secured to said pole only immediately below said body and extending upwardly alongside said body but spaced from the major portion of the length of said body to overlie the back of the hand gripping the body, said guard member having a free extremity turned toward but spaced from the top of said body, said member and said body being formed of an elastomer, said member including a support ring surrounding said pole immediately below said body, said body being rotatable on said pole independently of said ring to permit adjustment of the handle parts relative to each other and the ski pole during fabrication thereof, said body being thereafter fixed on said pole.

2. The handle defined in claim 1, further comprising a hand cylindrical sleeve carrying said ring and said body and carried on said pole.

3. A handle for a ski pole, said handle comprising:

an elongated tubular grip body adapted to fit over the upper end of a ski pole and to fit into the hand of a user, said body having a mushroom head at its upper end with a round edge; and an elongated resilient guard member secured to said pole immediately below said body and extending upwardly along-side said body but spaced from the major portion of the length of said body to overlie the back of a hand gripping said body, said guard member having a rounded free extremity approaching but spaced from said edge of said mushroom head, said guard member being concave in transverse cross-section and extending over an arc subtending an angle between 45° and 75° centered on the longitudinal axis of said pole, said guard member being of a length equal to a major fraction of the length of said grip body.

* * * * *